US009551180B2

(12) United States Patent
Xu et al.

(10) Patent No.: US 9,551,180 B2
(45) Date of Patent: Jan. 24, 2017

(54) SYSTEM FOR CONTROLLING NOISE IN A WINDOW ASSEMBLY

(71) Applicant: Milgard Manufacturing Incorporated, Tacoma, WA (US)

(72) Inventors: Jian Xu, Windsor (CA); Kevin D. Vilhauer, Puyallup, WA (US)

(73) Assignee: MILGARD MANUFACTURING INCORPORATED, Tacoma, WA (US)

( * ) Notice: Subject to any disclaimer, the term of this patent is extended or adjusted under 35 U.S.C. 154(b) by 244 days.

(21) Appl. No.: 14/295,850

(22) Filed: Jun. 4, 2014

(65) Prior Publication Data

US 2015/0358729 A1 Dec. 10, 2015

(51) Int. Cl.

| | |
|---|---|
| ***G10K 11/16*** | (2006.01) |
| ***E06B 7/00*** | (2006.01) |
| ***G10K 11/178*** | (2006.01) |
| *H04R 17/00* | (2006.01) |
| *H04R 17/02* | (2006.01) |

(52) U.S. Cl.

CPC ..... *E06B 7/00* (2013.01); *G10K 11/178* (2013.01); *G10K 2210/12* (2013.01); *G10K 2210/1291* (2013.01); *G10K 2210/3226* (2013.01); *G10K 2210/32291* (2013.01); *H04R 17/005* (2013.01); *H04R 17/025* (2013.01)

(58) Field of Classification Search

CPC ..... E06B 5/20; E06B 5/205; E06B 3/6707; E06B 3/7015; H04R 1/1083; H04R 1/28; H04R 3/002

See application file for complete search history.

(56) References Cited

U.S. PATENT DOCUMENTS

| | | | | |
|---|---|---|---|---|
| 3,792,204 | A | 2/1974 | Murayama et al. | |
| 5,528,314 | A | 6/1996 | Nagy et al. | |
| 5,812,684 | A | 9/1998 | Mark | |
| 6,427,017 | B1 * | 7/2002 | Toki | B06B 1/0688 181/170 |
| 6,791,519 | B2 | 9/2004 | Aarts et al. | |
| 6,957,516 | B2 | 10/2005 | Allaei | |
| 2005/0226435 | A1 * | 10/2005 | Steer | G10K 11/1788 381/71.7 |
| 2007/0081681 | A1 * | 4/2007 | Yu | B06B 1/0688 381/190 |

FOREIGN PATENT DOCUMENTS

| | | | |
|---|---|---|---|
| JP | 4334653 | A | 11/1992 |
| JP | 2007041110 | A | 2/2007 |

* cited by examiner

*Primary Examiner* — Paul S Kim
*Assistant Examiner* — Sabrina Diaz
(74) *Attorney, Agent, or Firm* — Rathe Lindenbaum LLP

(57) ABSTRACT

A system for controlling noise in a fenestration assembly (e.g., a window) includes a fenestration assembly with at least one glazing and a frame. The at least one glazing has a surface. At least one sensor is coupled to the at least one glazing and is configured to generate noise detection signals. An actuator is positioned on the surface of the at least one glazing and has a plurality of regions. A controller is coupled to the sensor and the actuator and is configured to control each of the regions of the actuator to generate a different frequency based on the noise detection signals. Alternatively, each of the regions may be controlled to generate a frequency with a different phase shift based on the noise detection signals.

22 Claims, 6 Drawing Sheets

SYSTEM FOR CONTROLLING NOISE IN A WINDOW ASSEMBLY

BACKGROUND

The present invention relates generally to the field of window (or fenestration) construction and in particular, to a system for controlling noise in a window (or fenestration) assembly. Sound transmission is an issue with many windows. Sound or noise can, for example, cause vibrations in a window assembly. Numerous solutions have been developed to control or reduce the noise transmitted through a window such as double pane (or glazing) windows where each pane of glass is a different thickness or density, vibration damping materials disposed between the window panes and laminated window panes. Typically, however, these solutions are limited in the number of frequencies that can be canceled to reduce the noise. It would be desirable to provide a system for actively controlling noise in a window assembly at a plurality of frequencies.

SUMMARY OF THE INVENTION

In accordance with an embodiment, a system for controlling noise in a fenestration assembly includes a fenestration assembly having at least one glazing and a frame, the at least one glazing having a surface, at least one sensor coupled to the at least one glazing and configured to generate noise detection signals, an actuator positioned on the surface of the at least one glazing, the actuator having a plurality of regions, and a controller coupled to the sensor and the actuator, the controller configured to control each of the regions of the actuator to generate a different frequency based on the noise detection signals.

In accordance with another embodiment, a system for controlling noise in a fenestration assembly includes a fenestration assembly having at least one glazing and a frame, the at least one glazing having a surface with a plurality of regions, at least one sensor coupled to the at least one glazing and configured to generate noise detection signals, a plurality of actuators positioned adjacent to the surface of the at least one glazing, each actuator corresponding to a region of the surface, and a controller coupled to the sensor and the plurality of actuators, the controller configured to control each of the actuators to generate a different frequency based on the noise detection signals.

In accordance with another embodiment, a system for controlling noise in a fenestration assembly includes a fenestration assembly having a first glazing, a second glazing and a frame, at least one sensor coupled to the first glazing and the second glazing and configured to generate noise detection signals, an actuator disposed between the first glazing and the second glazing and coupled to the frame, the actuator having a plurality of regions, and a controller coupled to the sensor and the actuator, the controller configured to control each of the regions of the actuator to generate a different frequency based on the noise detection signals.

In accordance with another embodiment, a system for controlling noise in a fenestration assembly includes a fenestration assembly comprising at least one glazing and a frame, the at least one glazing having a surface, at least one sensor coupled to the at least one glazing and configured to generate noise detection signals, an actuator positioned on the surface of the at least one glazing, the actuator having a plurality of regions, and a controller coupled to the at least one sensor and the actuator, the controller configured to control each of the regions of the actuator to generate a frequency with a different phase shift based on the noise detection signals.

DETAILED DESCRIPTION

Figure 1:
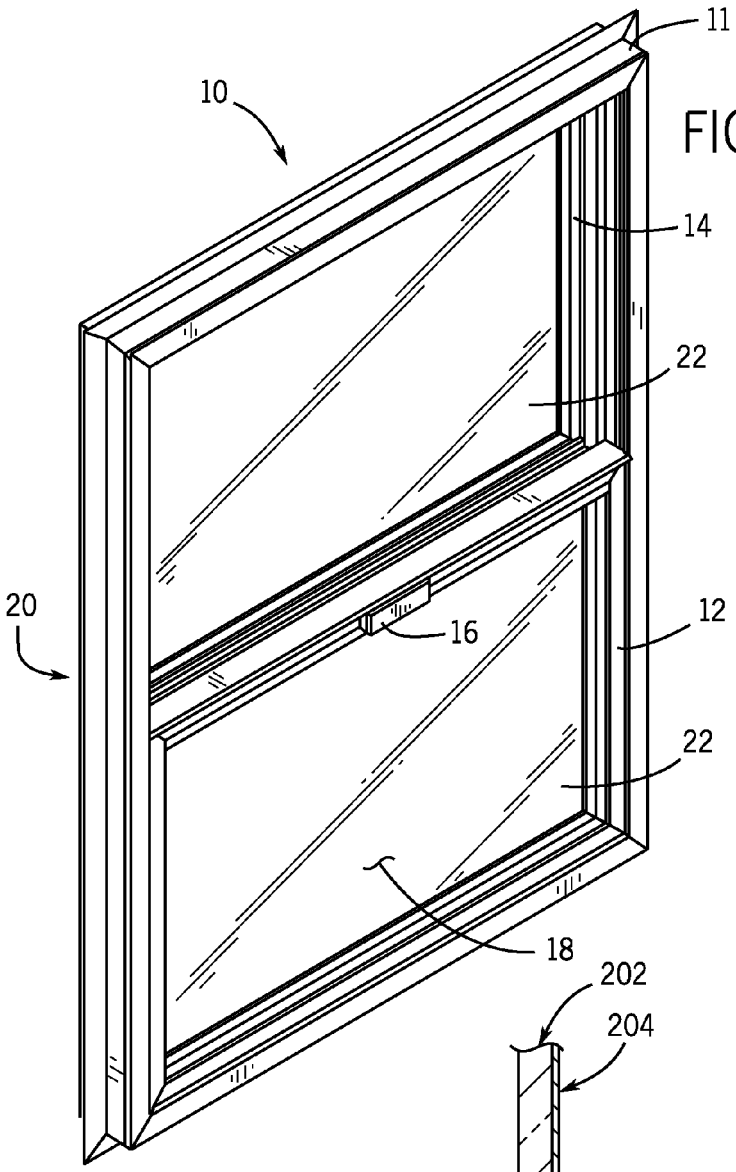
FIG. 1 is a perspective view of an exemplary window in accordance with an embodiment.

FIG. 1 is a perspective view of an exemplary window in accordance with an embodiment. In FIG. 1, a window 10 is shown having a frame 11, a first moveable sash 12, a second sash 14 and a latch 16. Within each sash 12, 14 is at least one glazing (or pane) 22 made of, for example, glass. Moveable sash 12 and sash 14 are generally mounted in frame 11 and allowed to slide vertically in frame 11 with moveable sash 12 sliding on a first, or inner track and sash 14 sliding in a second or outer track. Latch 16 is coupled to moveable sash 12 and releasably engages sash 14. Window 10 and glazings 22 have an inner or interior surface 18 that a person would see facing the window from inside of a building structure. Window 10 and glazings 22 have an outer or exterior surface 20 facing the exterior of a building structure and away from a person using the window. According to an exemplary embodiment, window 10 is a vertically sliding window or a "double hung" window. According to other exemplary embodiments, the second sash may be fixed or "single hung" window. According to still other exemplary embodiments, the window could be a horizontally sliding window or any other operating style of window.

Figure 2:
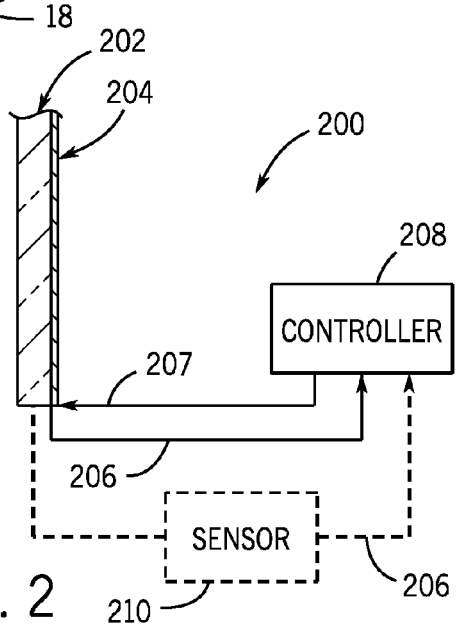
FIG. 2 is a schematic block diagram of a system for controlling noise in accordance with an embodiment.
Figure 3:
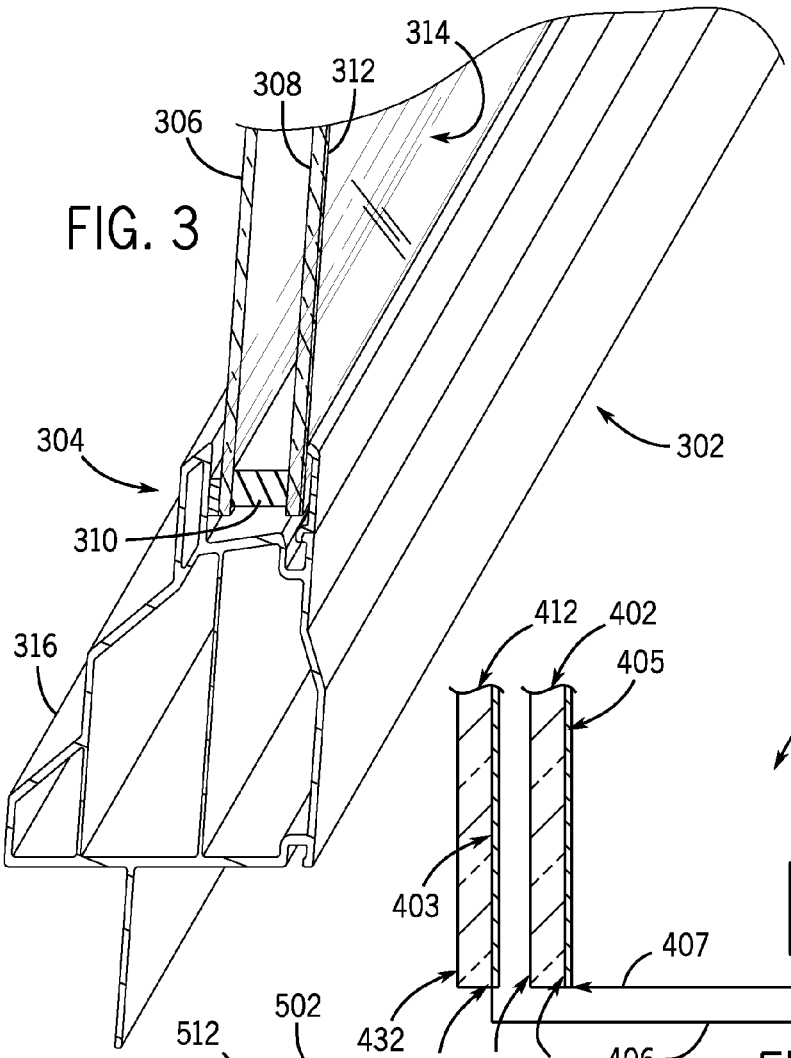
FIG. 3 is a cross-sectional view of a double pane window with piezoelectric film in accordance with an embodiment.

A window, or other fenestration assembly, may be provided with a system for controlling noise transmitted through the window. FIG. 2 is a schematic block diagram of a system for controlling noise in accordance with an embodiment. In FIG. 2, the system 200 includes a piezoelectric film 204 positioned on a target surface 202, for example, a window glazing (or pane). In a preferred embodiment, the piezoelectric film 204 is applied on the entire surface 202. The piezoelectric film 204 may be any known type of piezoelectric film such as, for example, polyvinylidene fluoride (PVDF). Preferably, the piezoelectric film 204 is a transparent piezoelectric film. In an embodiment, the piezoelectric film 204 is lead-free. FIG. 3 is a perspective cross-sectional view of a double pane window with a piezoelectric film in accordance with an embodiment. The window has an inner (or interior) side 302 and an outer (or exterior) side 304. A first glazing (or pane) 306 and a second glazing (or pane) 308 are positioned in a frame 316 with a spacer 310 placed between the first glazing 306 and the second glazing 308. A piezoelectric film 312 is applied to an inner (or interior) surface 314 of the second glazing 308. The piezoelectric film 312 may be applied to the glazing surface 314 using adhesives as known in the art. In various other embodiments, the piezoelectric film 312 may be applied to other surfaces of the first glazing 306 and the second glazing 308. It should be understood that while the embodiments described herein illustrate a flat glazing surface, the piezoelectric film may be applied to curved or other shaped glazing surfaces.

Returning to FIG. 2, the piezoelectric film 204 is coupled to a controller 208. In one embodiment, the piezoelectric film 204 is used as both a sensor to detect noise and an actuator to control or cancel noise. In another embodiment, the piezoelectric film 204 is used as an actuator to control or cancel noise and a separate sensor 210 (e.g., a microphone or a plurality of microphones) is coupled to the target surface 202 and the controller 208. The sensor (e.g., either the piezoelectric film 204 or sensor 210) is configured to detect noise, for example, vibrations in the target surface 202. The sensor generates noise detection signals 206 based on the detected noise vibrations and transmits the noise detection signals 206 to the controller 208. Based on the noise detection signals 206, the controller 208 generates control signals 207 designed to control the piezoelectric film to cancel or reduce the detected noise vibrations. The controller 208 applies the control signals 207 to the piezoelectric film (or actuator) 204 which causes the piezoelectric film to generate vibrations or sound waves at a particular frequency or, as discussed further below, at a plurality of frequencies. For example, in one embodiment, the control signals 207 cause the piezoelectric film 204 to generate vibrations that are the same amplitude but 180 degrees out of phase with the detected vibrations in the target surface 202 (e.g., a window glazing). In one embodiment, controller 208 may be housed in the frame of the window. Alternatively, the controller 208 may be positioned near the window, for example, mounted in or on a wall). In another embodiment, controller 208 may be coupled to and used to control a plurality of piezoelectric films on a plurality of windows.

Figure 4:
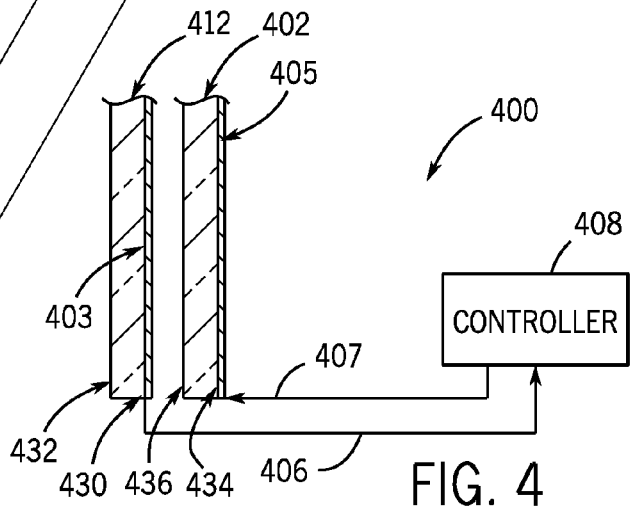
FIG. 4 is a schematic block diagram of a system for controlling noise in accordance with an embodiment.

In another embodiment, the sensor may be a separate piezoelectric film. FIG. 4 is a schematic block diagram of a system for controlling noise in accordance with an embodiment. In FIG. 4, the target surfaces may be a first glazing 402 and a second glazing 412 of a double pane window. A first piezoelectric film 403 is applied to an inner surface 430 of the second glazing 412 and is configured to be used as a sensor. In an alternative embodiment, the first piezoelectric film 403 may be applied to an outer surface 432 of the second glazing 412. Sensor 403 detects noise and generates noise detection signals 406 that are transmitted to a controller 408. Based on the noise detection signals 406, the controller 408 generates control signals 407 that are transmitted to a second piezoelectric film 405. The second piezoelectric film 405 is applied to an inner surface 434 of the first glazing 402 and is configured to be used as an actuator. In an alternative embodiment, the second piezoelectric film 405 may be applied to an outer surface 436 of the first glazing 402. The control signals 407 cause the second piezoelectric film 405 to generate vibrations to cancel or reduce noise.

Figure 5:
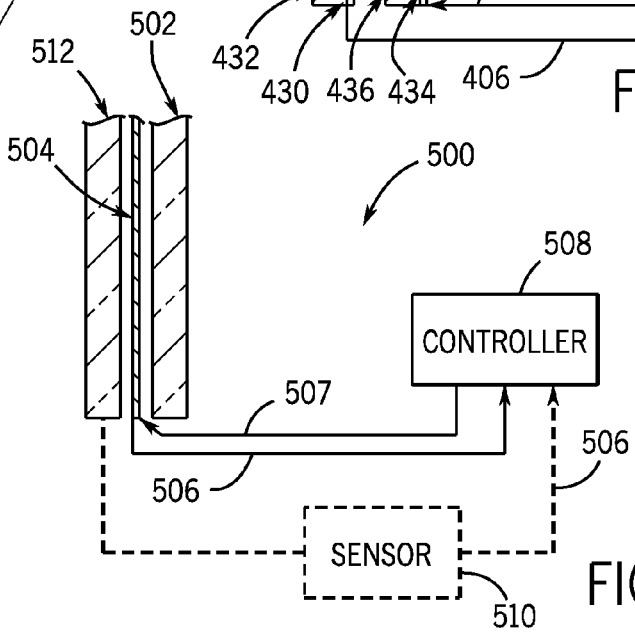
FIG. 5 is a schematic block diagram of a system for controlling noise in accordance with an embodiment.
Figure 6:
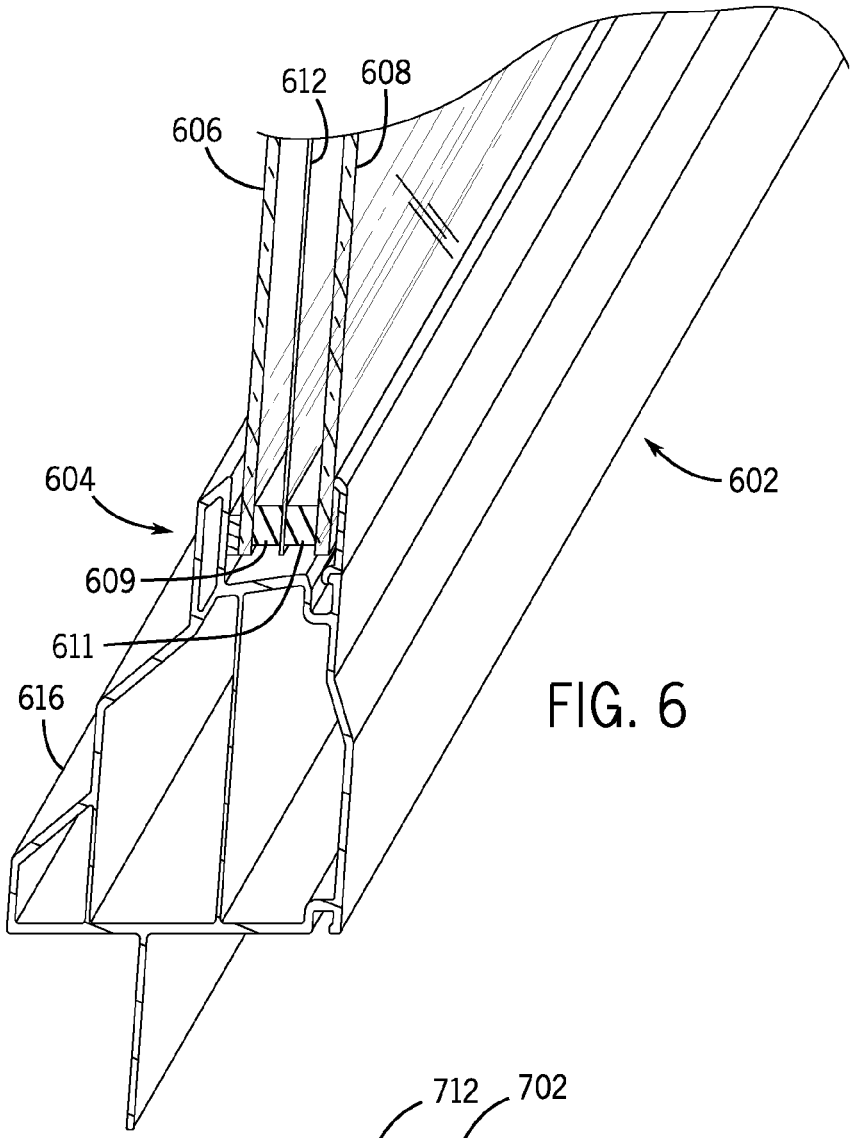
FIG. 6 is a cross-sectional view of a double pane window with a suspended piezoelectric film in accordance with an embodiment.

In another embodiment, the piezoelectric film 204 of system 200 shown in FIG. 2 may be suspended between two surfaces such as a first glazing and a second glazing. FIG. 5 is a schematic block diagram of a system for controlling noise in accordance with an embodiment. In FIG. 5, the target surfaces may be a first glazing 502 and a second glazing 512 of a double pane window. The noise control system 500 includes a piezoelectric film 504 that is suspended between the first glazing 502 and the second glazing 512. In a preferred embodiment, the piezoelectric film 504 has a similar surface area as the first glazing 502 and the second glazing 512. The piezoelectric film 504 may be any known type of piezoelectric film such as, for example, polyvinylidene fluoride (PVDF). Preferably, the piezoelectric film 504 is a transparent piezoelectric film. In an embodiment, the piezoelectric film 504 is lead-free. FIG. 6 is a perspective cross-sectional view of a double pane window with a piezoelectric film in accordance with an embodiment. The window has an inner (or interior) side 602 and an outer (or exterior) side 604. A first glazing 606 and a second glazing 608 are positioned in a frame 616 with a first spacer 609 and a second spacer 611. A piezoelectric film 612 is suspended between the first glazing 606 and the second glazing 608 and supported between the first spacer 609 and the second spacer 611. The piezoelectric film 612 may be connected to or bonded to the first spacer 609 and the second spacer 611 using methods known in the art.

Returning to FIG. 5, the piezoelectric film 504 is coupled to a controller 508. As discussed above, in one embodiment, the piezoelectric film 504 is used as both a sensor to detect noise and an actuator to control or cancel noise. In another embodiment, the piezoelectric film 504 is used as an actuator to control or cancel noise and a separate sensor 510 (e.g., a microphone or a plurality of microphones) is coupled to the target surfaces 502, 512 and the controller 508. The sensor (e.g., either the piezoelectric film 504 or sensor 510) is configured to detect noise, for example, vibrations in the target surfaces 502, 512 and to generate noise detection signals 506 based on the detected noise vibrations. The noise detection signals 506 are transmitted to the controller 508 which generates control signals 507 designed to control the piezoelectric film to cancel or reduce the detected noise vibrations. The controller 508 applies the control signals 507 to the piezoelectric film (or actuator) 504 which causes the piezoelectric film to generate vibrations or sound waves at a particular frequency or, as discussed further below, at a plurality of frequencies. For example, in one embodiment, the control signals 507 cause the piezoelectric film 504 to generate vibrations that are the same amplitude but 180 degrees out of phase with the detected vibrations in the target surfaces 502, 512 (e.g., a window glazing).

Figure 7:
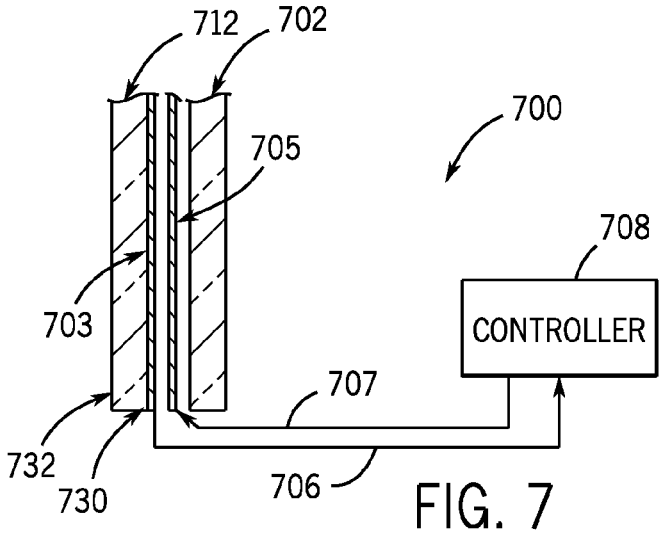
FIG. 7 is a schematic block diagram of a system for controlling noise in accordance with an embodiment.

In another embodiment, the sensor may be a separate piezoelectric film. FIG. 7 is a schematic block diagram of a system for controlling noise in accordance with an embodiment. In FIG. 7, the target assembly for noise control is a double pane window that includes a first glazing 702 and a second glazing 712. In FIG. 7, a first piezoelectric film 703 is applied to an inner surface 730 of the second glazing 712 and is configured to be used as a sensor. In an alternative embodiment, the first piezoelectric film 703 may be applied to an outer surface 732 of the second glazing 712. Sensor 703 detects noise and generates noise detection signals 706 that are transmitted to a controller 708. Based on the noise detection signals 706, the controller 708 generates control signals 707 that are transmitted to a second piezoelectric film 705. The second piezoelectric film 705 is suspended between the first glazing 702 and the second glazing 712 and is configured to be used as an actuator. The control signals 707 cause the second piezoelectric film 705 to generate vibrations to cancel or reduce noise.

As mentioned above, the system for controlling noise may be configured to cancel or reduce noise at a plurality of frequencies. Accordingly, the target surface (or surfaces) may be considered to have a plurality of regions or zones. In one embodiment, the piezoelectric film (or actuator) is configured to have a plurality of regions corresponding to the plurality of regions of the target surface. Each region of the piezoelectric film may be controlled to generate a different frequency or, alternatively, to generate the same frequency with a different phase shift. In another embodiment, a separate piezoelectric film may be used as an actuator for each of the plurality of regions. Each piezoelectric film may be controlled to generate a different frequency or, alternatively, to generate the same frequency with a different phase shift. In various embodiments where the sensor is also a piezoelectric film (either the same piezoelectric film as the actuator or a separate piezoelectric film), the sensor may be configured to have a plurality of regions corresponding to the regions of the target surface. Each region of the sensor may be used to detect one or more frequencies. The frequency or frequencies detected by each region may be the same or different. In another embodiment, a separate piezoelectric film may be used as a sensor for each of the plurality of regions. Each piezoelectric film may be used to detect one or more frequencies. The frequency or frequencies detected by each piezoelectric film may be the same or different.

Figure 8:
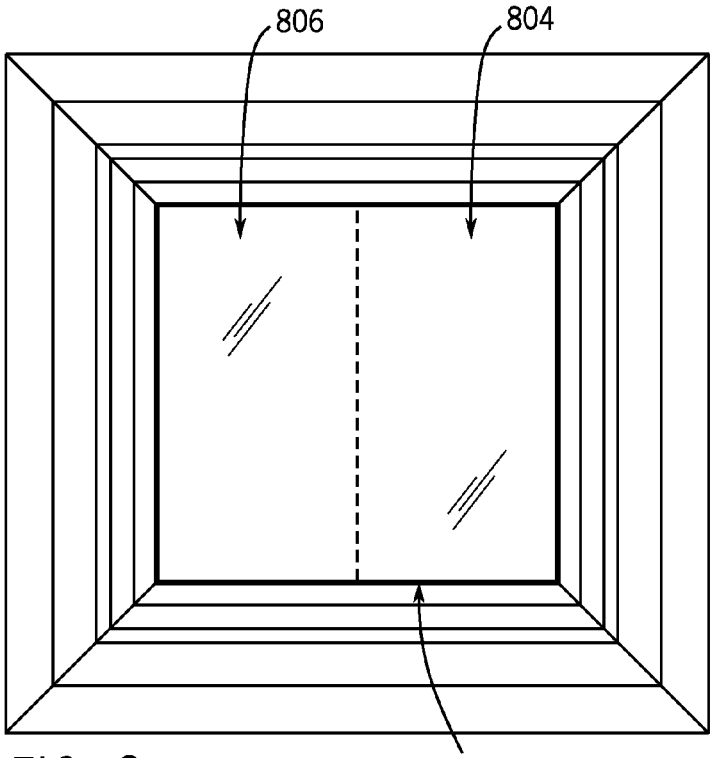
FIG. 8 illustrates a window glazing and a piezoelectric film with two regions in accordance with an embodiment.
Figure 9:
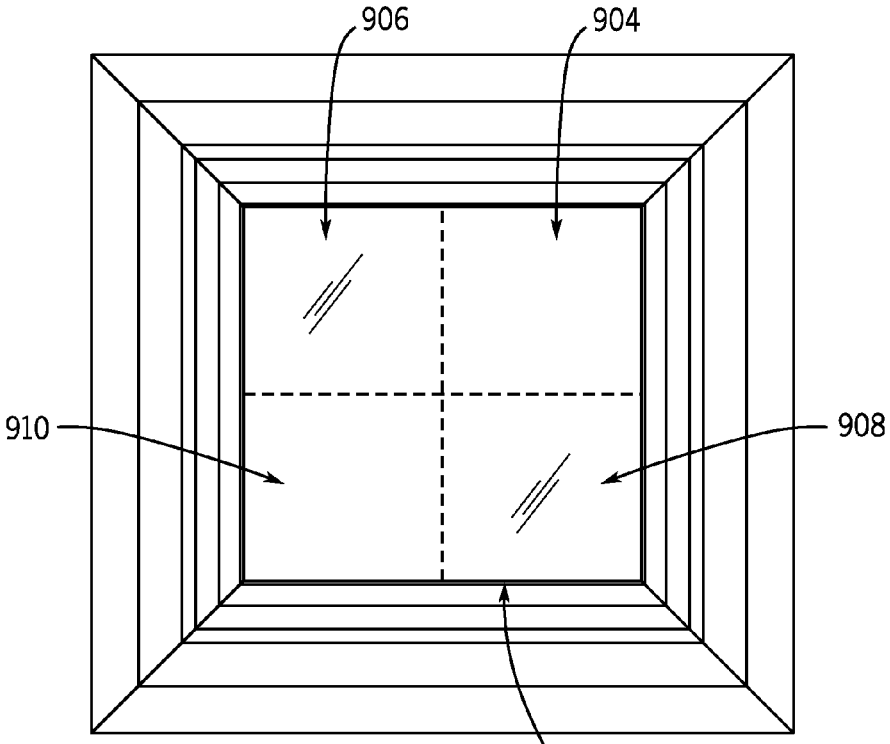
FIG. 9 illustrates a window glazing and piezoelectric film with four regions in accordance with an embodiment.
Figure 10:
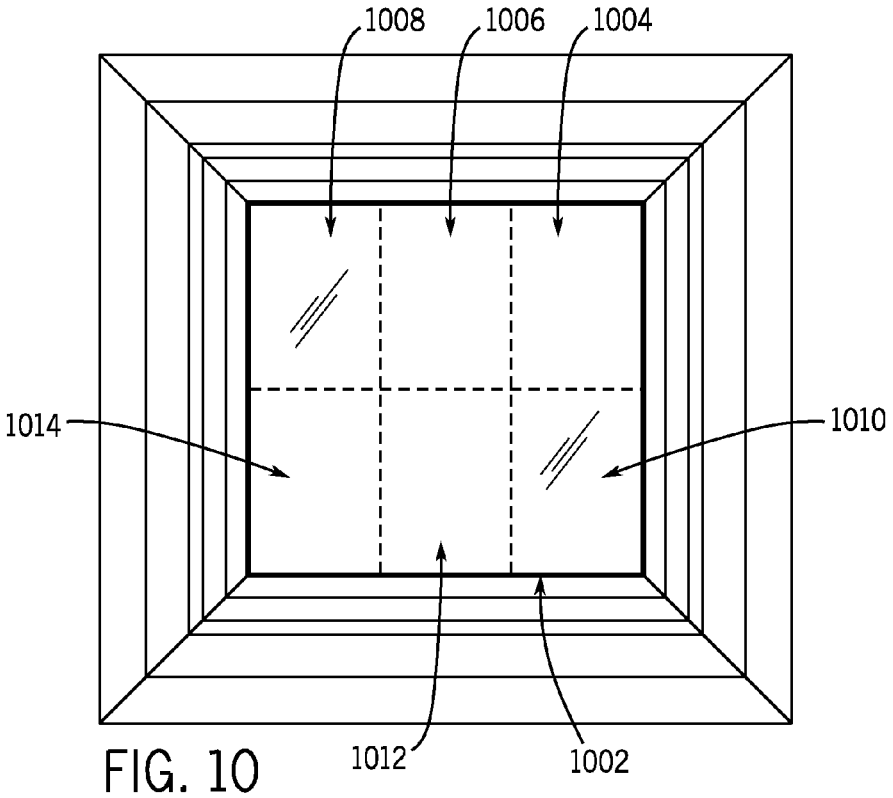
FIG. 10 illustrates a window glazing and piezoelectric film with six regions in accordance with an embodiment.

FIGS. 8-10 illustrate exemplary window glazings with a plurality of regions in accordance with various embodiments. In FIG. 8, an exemplary window glazing 802 is shown with a first region 804 and a second region 806. In one embodiment, a single piezoelectric film is applied to cover the entire surface of the window glazing 802. The two regions 804, 806 are created in the piezoelectric film by creating a break in the conductive material in the piezoelectric film so that the first region 804 and the second region 806 are not in electrical communication. For example, if a composite piezoelectric film with carbon nanotubes is used, the piezoelectric film may be printed so that there is a break between the carbon nanotubes in each region 804, 806 and therefore, the two regions 804, 806 are not in electrical communication. Each region 804, 806 may be controlled (e.g., using controller 208 shown in FIG. 2) to generate a different frequency to cancel and reduce the detected noise. Alternatively, each region 804, 806 may be controlled to generate the same frequency with a different phase shift. In an embodiment where the piezoelectric film is a sensor, each region may be used to detect one or more frequencies. The frequency or frequencies detected by each region may be the same or different. In another embodiment, a first piezoelectric film may be applied to the first region 804 and a second piezoelectric film may be applied to the second region 806. Each of the piezoelectric films may be controlled to generate a different frequency to cancel and reduce the detected noise. In an embodiment where each piezoelectric film is a sensor, each piezoelectric film may be used to detect one or more frequencies. The frequency or frequencies detected by each piezoelectric film may be the same or different.

In FIG. 9, an exemplary window glazing 902 is shown with a first region 904, a second region 906, a third region 908 and a fourth region 910. In one embodiment, a single piezoelectric film is applied to cover the entire surface of the window glazing 902. The four regions 904, 906, 908, 910 are created in the piezoelectric film by creating a break in the conductive material in the piezoelectric film so that the four regions are not in electrical communication with each other. In another embodiment, a separate piezoelectric film may be applied to each of the four regions 904, 906, 908, 910. In each embodiment, the different regions may be controlled to generate different frequency. Alternatively, the different regions may be controlled to generate the same frequency with a different phase shift. In an embodiment where the piezoelectric film is a sensor, each region may be used to detect one or more frequencies. The frequency or frequencies detected by each region may be the same or different.

In FIG. 10, an exemplary window glazing 1002 is shown with a first region 1004, a second region 1006, a third region 1008, a fourth region 1010, a fifth region 1012 and a sixth region 1014. In one embodiment, a single piezoelectric film is applied to cover the entire surface of the window glazing 1002. The six regions 1004, 1006, 1008, 1010, 1012, 1014 are created in the piezoelectric film by creating a break in the conductive material in the piezoelectric film so that the six regions are not in electrical communication with each other. In another embodiment, a separate piezoelectric film may be applied to each of the six regions 1004, 1006, 1008, 1010, 1012, 1014. In each embodiment, the different regions may be controlled to generate different frequency. Alternatively, the different regions may be controlled to generate the same frequency with a different phase shift. In an embodiment where the piezoelectric film is a sensor, each region may be used to detect one or more frequencies. The frequency or frequencies detected by each region may be the same or different.

Figure 11:
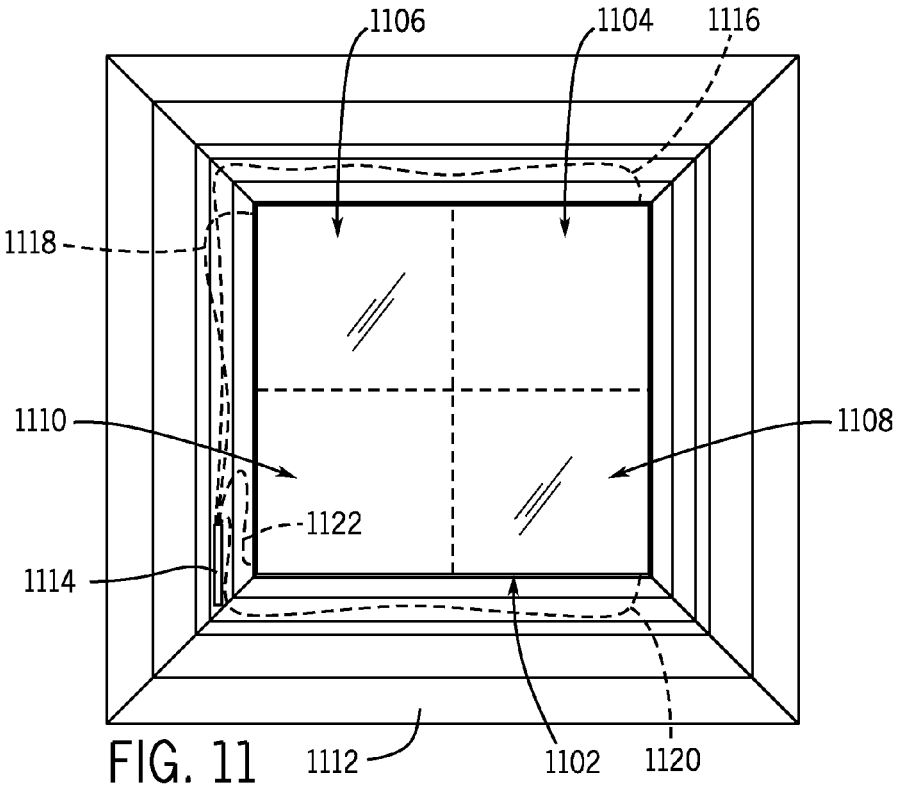
FIG. 11 illustrates an exemplary window with a controller for a system for controlling noise in accordance with an embodiment.

As discussed above, a controller is coupled to the piezoelectric film (or films) to provide control signals to the piezoelectric film. In addition, if the piezoelectric film (or films) is used as a sensor, the controller receives noise detection signals from the piezoelectric film. FIG. 11 illustrates an exemplary window with a controller for a system for controlling noise in accordance with an embodiment. A window glazing 1102 is positioned in a frame 1112. The glazing 1102 is shown with a first region 1104, a second region 1106, a third region 1108 and a fourth region 1110. In one embodiment, a single piezoelectric film is applied to cover the entire surface of the window glazing 1102. In another embodiment, a separate piezoelectric film may be applied to each region 1104, 1106, 1108, 1110. In yet another embodiment, the piezoelectric film is suspended between two window glazings (not shown). A controller 1114 is disposed within the frame 1112. Alternatively, the controller 1114 may be positioned near the window, for example, mounted in or on a wall). The controller 1114 is electrically coupled to the piezoelectric film in each region 1104, 1106, 1108, 1110. A first electrical connection 1116 couples the controller 1114 to the first region 1104, a second electrical connection 1118 couples the controller 1114 to the second region 1106, a third electrical connection 1120 coupled the controller to the third region 1108 and a fourth electrical connection 1122 couples the controller 1114 to the fourth region 1110. In various embodiments, more than one controller may be used. A controller may be used with multiple regions, for example, a first controller may be coupled to the first region 1104 and the second region 1106 and a second controller may be coupled to the third region 1108 and the fourth region 1110. In another example, a separate controller may be used for each region, for example, a first controller may be coupled to the first region 1104, a second controller may be coupled to the second region 1106, a third controller may be coupled to the third region 1108 and a fourth controller coupled to the fourth region 1110.

Controller 1114 provides control signals to the piezoelectric film in each region 1104, 1106, 1108, 1110 to generate vibrations to cancel or reduce noise. The piezoelectric film in each region may be used to generate a different frequency of vibrations or, alternatively, vibrations with same frequency but different phase shifts. For example, the first region 1104 may be used to generate a first frequency, the second region 1106 may be used to generate a second frequency, the third regions 1108 may be used to generate a third frequency and the fourth region 1110 may be used to generate a fourth frequency. In another example, the first region 1104 may be used to generate a first frequency with a first phase shift, the second region 1106 may be used to generate the first frequency with a second phase shift, the third regions 1108 may be used to generate the first frequency with a third phase shift and the fourth region 1110 may be used to generate the first frequency with a fourth phase shift. In an embodiment where the piezoelectric film is a sensor, each region may be used to detect one or more frequencies. The frequency or frequencies detected by each region may be the same or different.

Figure 12:
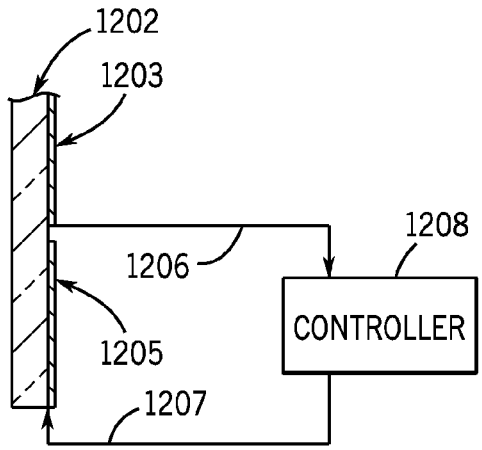
FIG. 12 is a schematic block diagram of a system for controlling noise in accordance with an embodiment.

FIG. 12 is a schematic block diagram of a system for controlling noise in accordance with an embodiment. In FIG. 12, a first piezoelectric film 1203 is applied to a target surface 1202 (e.g., a glazing) and is configured to be used as a sensor. Sensor 1203 detects noise and generates noise detection signals 1206 that are transmitted to a controller 1208. Based on the noise detection signals 1206, the controller 1208 generates control signals 1207 that are transmitted to a second piezoelectric film 1205. The second piezoelectric film 1205 is applied to the target surface 1202 and is configured to be used as an actuator. The control signals 1207 cause the second piezoelectric film 1205 to generate vibrations to cancel or reduce noise. As discussed above, the second piezoelectric film 1205 (or actuator) may have a plurality of regions, each of which may generate a different frequency or, alternatively, to generate the same frequency with a different phase shift. In addition, the first piezoelectric film 1203 (or sensor) may have a plurality of regions, each of which may detect one or more frequencies. The frequency or frequencies detected by each region may be the same or different.

Figure 13:
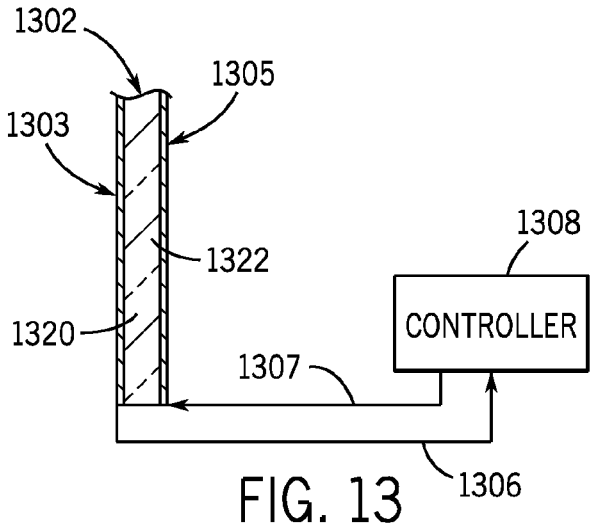
FIG. 13 is a schematic block diagram of a system for controlling noise in accordance with an embodiment.

FIG. 13 is a schematic block diagram of a system for controlling noise in accordance with an embodiment. In FIG. 13, a first piezoelectric film 1303 is applied to a first surface 1320 of a target assembly (e.g., a first side of a glazing in a window assembly) and is configured to be used as a sensor. Sensor 1303 detects noise and generates noise detection signals 1306 that are transmitted to a controller 1308. Based on the noise detection signals 1306, the controller 1308 generates control signals 1307 that are transmitted to a second piezoelectric film 1305. The second piezoelectric film 1305 is applied to a second surface 1322 of the target assembly and is configured to be used as an actuator. The control signals 1307 cause the second piezoelectric film 1305 to generate vibrations to cancel or reduce noise. As discussed above, the second piezoelectric film 1305 (or actuator) may have a plurality of regions, each of which may generate a different frequency or, alternatively, to generate the same frequency with a different phase shift. In addition, the first piezoelectric film 1303 (or sensor) may have a plurality of regions, each of which may detect one or more frequencies. The frequency or frequencies detected by each region may be the same or different.

Figure 14:
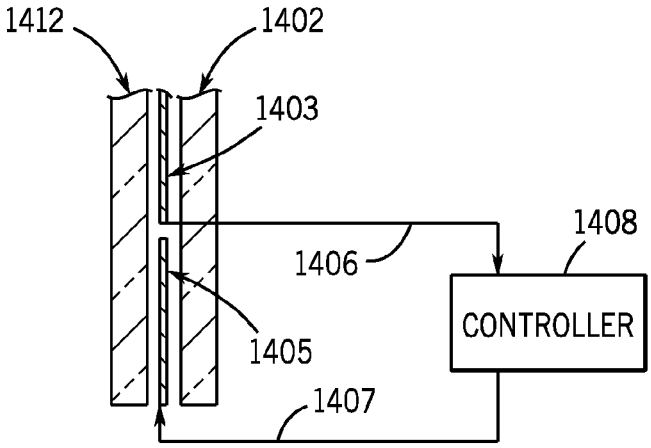
FIG. 14 is a schematic block diagram of a system for controlling noise in accordance with an embodiment.

FIG. 14 is a schematic block diagram of a system for controlling noise in accordance with an embodiment. In FIG. 14, a first piezoelectric film 1403 is suspended between, for example, a first glazing 1402 and a second glazing 1412 of a double pane window and is configured to be used as a sensor. Sensor 1403 detects noise and generates noise detection signals 1406 that are transmitted to a controller 1408. Based on the noise detection signals 1406, the controller 1408 generates control signals 1407 that are transmitted to a second piezoelectric film 1405. The second piezoelectric film 1405 is also suspended between the first glazing 1402 and the second glazing 1412 and is configured to be used as an actuator. The control signals 1407 cause the second piezoelectric film 1405 to generate vibrations to cancel or reduce noise. As discussed above, the second piezoelectric film 1405 (or actuator) may have a plurality of regions, each of which may generate a different frequency or, alternatively, to generate the same frequency with a different phase shift. In addition, the first piezoelectric film 1403 (or sensor) may have a plurality of regions, each of which may detect one or more frequencies. The frequency or frequencies detected by each region may be the same or different.

Computer-executable instructions for controlling noise in a fenestration assembly according to the above-described method may be stored on a form of computer readable media. Computer readable media includes volatile and non-volatile, removable, and non-removable media implemented in any method or technology for storage of information such as computer readable instructions, data structures, program modules or other data. Computer readable media includes, but is not limited to, random access memory (RAM), read-only memory (ROM), electrically erasable programmable ROM (EEPROM), flash memory or other memory technology, compact disk ROM (CD-ROM), digital versatile disks (DVD) or other optical storage, magnetic cassettes, magnetic tape, magnetic disk storage or other magnetic storage devices, or any other medium which can be used to store the desired instructions and which may be accessed by system 10 (shown in FIG. 1), including by internet or other computer network form of access.

It is important to note that the construction and arrangement of system for controlling noise in a fenestration assembly as described herein is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements and vice versa, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the exemplary embodiments without departing from the scope of the present inventions as expressed in the appended claims.

What is claimed is:

1. A system for controlling noise in a fenestration assembly, the system comprising:

a fenestration assembly comprising a frame, a first glazing having a surface and a second glazing having a surface;

at least one sensor positioned on the surface of the first glazing and configured to generate noise detection signals, wherein the at least one sensor is a piezoelectric film;

an actuator positioned on the surface of the second glazing, the actuator having a plurality of regions, wherein the actuator is a piezoelectric film; and a controller coupled to the at least one sensor and the actuator, the controller configured to control each of the regions of the actuator to generate a different frequency based on the noise detection signals.

2. A system according to claim 1, wherein the piezoelectric film of the at least one sensor is lead-free and transparent and the piezoelectric film of the actuator is lead-free and transparent.

3. A system according to claim 1, wherein the actuator covers substantially all of the surface of the second glazing.

4. A system according to claim 1, wherein each of the regions of the actuator is a separate piezoelectric film applied to the surface of the second glazing.

5. A system according to claim 4, wherein the plurality of regions cover substantially all of the surface of the second glazing.

6. A system according to claim 1, wherein the at least one sensor has a plurality of regions, each region configured to detect at least one frequency.

7. A system according to claim 1, wherein the controller is disposed within the frame.

8. A system according to claim 1, wherein the controller comprises a plurality of controllers, each controller coupled to at least one region of the actuator.

9. A system for controlling noise in a fenestration assembly, the system comprising:

a fenestration assembly comprising at least one glazing and a frame, the at least one glazing having a first surface and a second surface;

at least one sensor positioned on the first surface of the at least one glazing and configured to generate noise detection signals, wherein the at least one sensor is a piezoelectric film;

an actuator positioned on the second surface of the at least one glazing, the actuator having a plurality of regions, wherein the actuator is a piezoelectric film; and a controller coupled to the at least one sensor and the actuator, the controller configured to control each of the regions to generate a different frequency based on the noise detection signals.

10. A system according to claim 9, wherein the at least one sensor has a plurality of regions, each region configured to detect at least one frequency.

11. A system according to claim 9, wherein the controller comprises a plurality of controllers, each controller coupled to the actuator.

12. A system for controlling noise in a fenestration assembly, the system comprising:

a fenestration assembly comprising a first glazing, a second glazing and a frame;

at least one sensor coupled to the first glazing and the second glazing and configured to generate noise detection signals;

an actuator disposed between the first glazing and the second glazing and coupled to the frame, the actuator having a at least a first region and a second region; and a controller coupled to the at least one sensor and the actuator, the controller configured to control the first region of the actuator to generate a first frequency with a first phase shift based on the noise detection signals and to control the second region of the actuator to generate the first frequency with a second phase shift based on the noise detection signals.

13. A system according to claim 12, wherein the actuator is a piezoelectric film.

14. A system according to claim 13, wherein the piezoelectric film is lead-free and transparent.

15. A system according to claim 12, wherein each of the regions of the actuator is a separate piezoelectric film.

16. A system according to claim 13, wherein the frame comprises a first spacer and a second spacer and the piezoelectric film is coupled to the first spacer and the second spacer.

17. A system according to claim 15, wherein the frame comprises a first spacer and a second spacer and each of the piezoelectric films is coupled to the first spacer and the second spacer.

18. A system according to claim 12, wherein the at least one sensor is a piezoelectric film and has a plurality of regions, each region configured to detect at least one frequency.

19. A system according to claim 12, wherein the controller comprises a plurality of controllers, each controller coupled to at least one region of the actuator.

20. A system for controlling noise in a fenestration assembly, the system comprising:

a fenestration assembly comprising at least one glazing and a frame, the at least one glazing having a surface;

at least one sensor coupled to the at least one glazing and configured to generate noise detection signals;

an actuator positioned on the surface of the at least one glazing, the actuator having at least a first region and a second region; and a controller coupled to the at least one sensor and the actuator, the controller configured to control the first region of the actuator to generate a first frequency with a first phase shift based on the noise detection signals and to control the second region of the actuator to generate the first frequency with a second phase shift based on the noise detection signals.

21. A system according to claim 20, wherein the actuator is a piezoelectric film applied to the surface of the at least one glazing.

22. A system according to claim 20, wherein the first region of the actuator and the second region of the actuator are separate piezoelectric films applied to the surface of the at least one glazing.

* * * * *